US005941225A

United States Patent [19]

Tentler et al.

[11] Patent Number: 5,941,225

[45] Date of Patent: Aug. 24, 1999

[54] OVER AND UNDER BOW STRING RELEASE WITH AXIAL ADJUSTMENT

[75] Inventors: Lynn A. Tentler; Paul L. Peck, both of Fond Du Lac, Wis.

[73] Assignee: Tru-Fire Corporation, N. Fon Du Lac, Wis.

[21] Appl. No.: 08/995,733

[22] Filed: Dec. 22, 1997

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 5,020,508 | 6/1991 | Greene | 124/35.2 |
| 5,448,983 | 9/1995 | Scott | 124/35.2 |
| 5,615,662 | 4/1997 | Tentler et al. | 124/35.2 |
| 5,653,213 | 8/1997 | Linsmeyer | 124/35.2 |
| 5,653,214 | 8/1997 | Lynn | 124/35.2 |

*Primary Examiner*—John A. Ricci
*Attorney, Agent, or Firm*—Bracewell & Patterson

[57] ABSTRACT

The subject invention provides a bow string release mechanism over and under bow string retaining jaws and an axial adjustment mechanism for altering the distance of the jaws from a wrist strap. The release mechanism generally comprises a release mechanism, a wrist strap, and a rotatable shaft assembly joining the release mechanism and the wrist strap, wherein the axial distance between release mechanism and the wrist strap can be adjusted by axial rotation of the shaft assembly. The release mechanism comprises a trigger mechanism, a body in which the trigger mechanism is mounted and actuated and a sear head attached to the body and actuable by the trigger mechanism. The sear head has a first fixed over and under sear element and a second pivotally attached over and under sear element, movable relative to the first fixed sear element, into and out of engagement therewith upon actuation of the trigger mechanism. The rotatable shaft assembly comprises a threaded bore at one end of a shaft to engage an externally threaded adjusting rod attached to the wrist strap. The shaft is attached at its other end, via a ball and socket coupling, to the release mechanism. The ball and socket coupling permits the release mechanism to freely pivot about the end of the shaft assembly. The threaded bore of the shaft permits the distance between the release mechanism and the strap to be rotatingly adjusted to accommodate various hand sizes.

11 Claims, 3 Drawing Sheets

FIG. 4
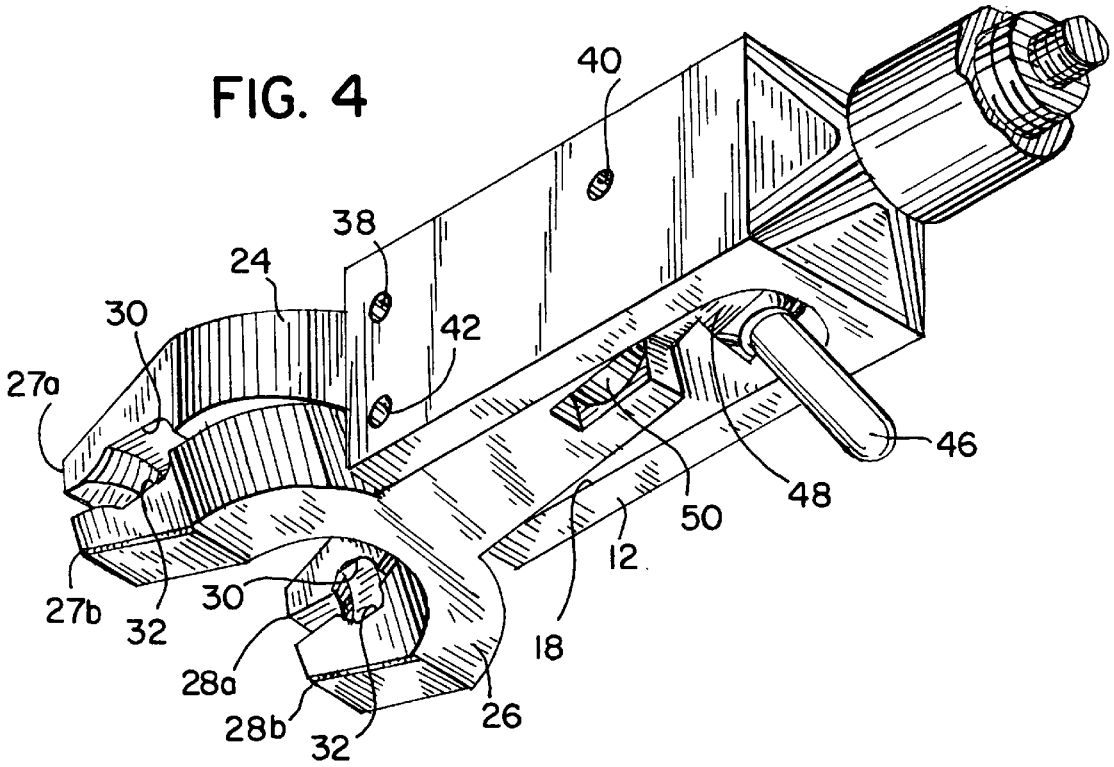
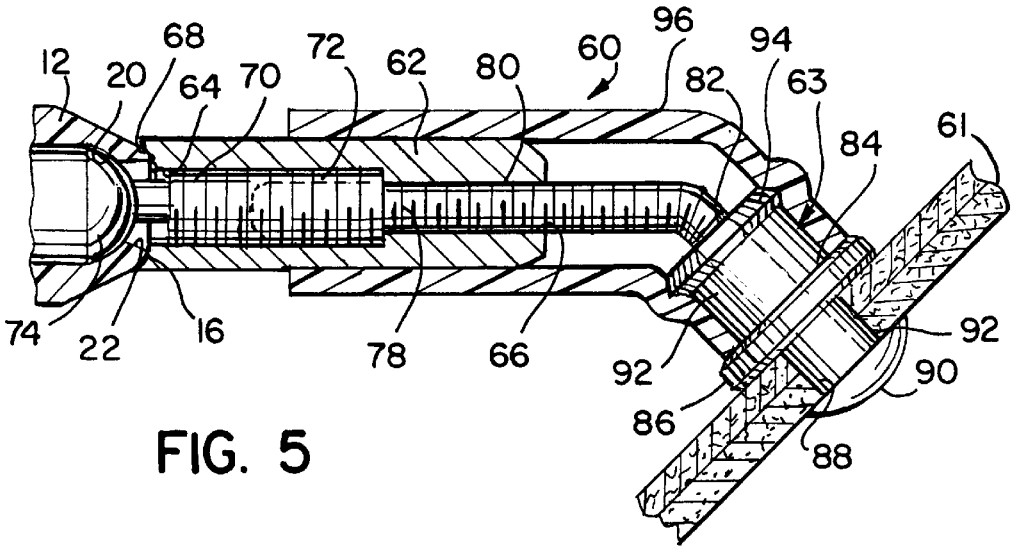
FIG. 5

OVER AND UNDER BOW STRING RELEASE WITH AXIAL ADJUSTMENT

BACKGROUND OF THE INVENTION

1. Field of the Invention

This invention is generally related to bow string releases and is specifically directed to a release having over and under jaws and an axial adjustment mechanism.

2. Discussion of the Prior Art

Various forms of mechanical archery bow string releases have become increasingly popular in recent years because they provide uniform control of a bow string and an increase in accuracy by effecting a consistent, controlled release of an arrow. Such releases are typically used to maintain the bow string in a cocked position in which the bow string is flexed against the tension of a bow for propelling an arrow supported on the bow string. When a drawn arrow is released from a release mechanism, the release is usually relatively rapid and at a point approximately in line with the centerline of the bow so that the bow string delivers most of its thrust directly along the major axis of the arrow. When tabs or fingers are used to release a bow string, the bow string tends to roll off the fingers or tab and be deflected sideways during release such that the bow string follows a serpentine path, failing to maximize energy delivery directly along the major axis of the arrow.

An arrow itself is generally comprised of a shaft with a point mounted on one end and a nock mounted on the opposite end. A standard arrow nock has a bow string receiving groove or notch defined by spaced apart legs extending from a base. The notched nock is configured to receive a bow string and insure stability of the arrow during cocking and release of the bow string. When an arrow is loaded on a bow in this manner, the legs of the arrow nock extend beyond the bow string toward the archer such that an arrow can pivot from side to side about the bow string. When loaded, the nock of an arrow is preferably seated at or near the mid-point of the bow string to insure that the flight of the arrow is as true as possible.

Most bow string releases employ a trigger mechanism to activate the bow string retaining and release mechanism. Typically, the release mechanism engages a bow string at a single point, utilizing either pivotable jaws or a pin and flexible eyed loop as the sear means for retaining the bow string. Some releases attach directly to the corresponding bow string and other releases cooperate with bow string mounted anchors or arrow nock holders having portions adapted to be engaged by the releases. In any event, the releases attach at or near the mid-point of the bow string, adjacent the arrow nock, to enhance thrust of the arrow. One drawback to these prior art devices is that such release mechanisms are not generally coaxially aligned with the arrow shaft. Rather, the release engages the bow string at a single point just above or below the arrow, set off from the axis of the arrow. In such cases, the bow string at its point of contact with the arrow nock is angled relative to the arrow nock rather than being flush against the base of the arrow nock. This alignment can effect the arrow's flight path, causing the arrow to wander during flight. For example, a release mechanism engaging a bow string just above an arrow is likely to cause the flight path of an arrow to angle downward, while a release mechanism engaging a bow string just below an arrow is likely to cause the flight path of an arrow to angle upward.

One solution to permit coaxial alignment of a release mechanism with an arrow is to provide structures or "receivers" that attach to bow strings to support an arrow nock and provide a point of attachment for a release mechanism. For example, U.S. Pat. No. 5,537,986 teaches a device comprised of an open-mouthed, U-shaped member that generally attaches to a bow string at substantially the mid-point of the bow string. The ends of the U-shaped member attach just above and just below the arrow nock with the bowl portion extending behind the bow string such that the apex of the bowl is along the axis of a seated arrow. The release mechanism attaches to the backwardly extending bowl of the U-shaped member. This type of receiver permits a release mechanism to engage the bow string in substantially coaxial alignment with an arrow and allows the nock of a drawn arrow to seat flush against the bow string as the string is drawn and released. In other words, the portion of the arrow string against which the nock seats is maintained substantially perpendicular to the axis of the arrow rather than skewed relative to the arrow's axis.

A release mechanism that attaches directly to a bow string and permits coaxial alignment of an arrow and the release is taught in U.S. Pat. No. 5,020,508 issued to Greene. In Greene, the release is provided with two pivotable jaw heads, wherein each jaw head is U-shaped to provided upper and lower bow string engagement structures. Each U-shaped jaw is pivotally mounted on a base to move into and out of engagement with the other U-shaped jaw. Specifically, upper and lower bow string members mate with their respective counterparts to secure the bow string at two spaced apart points on opposite sides of a seated arrow nock. The jaws are disposed to simultaneously move laterally toward or away from one another as they pivot about their respective pivot pins under actuation by a trigger mechanism. One drawback to such a device is that the pivotal nature of both jaws increases the complexity of the device and renders it more susceptible to failure than less complex devices employing fewer moving parts. This is especially undesirable under typical conditions in which such bow string devices are used, where the environment may include rain, snow, water, mud or other debris that could hinder operation of moving parts. In addition, typically, the more moving parts, the greater the relative cost of the device.

In many cases, bow string releases such as those described above are secured to an archer's wrist, permitting the release to be held in a ready position while freeing the fingers of the hand for other tasks. Also, by attaching the release to an archer's wrist, the amount of strain on the hand is greatly decreased when high draw weight bows are utilized, which is typical in archery hunting and archery tournaments. Many various wrist straps and harnesses are available for bow string releases, such as for example, the widely accepted V-type wrist strap. Commonly, the release is pivotally attached, via an elongated, cylindrical shaft, to an enlarged palm area or base which forms part of the strap.

One drawback to such wrist mounted straps is that the devices are not disposed to accommodate hands of varying sizes, such that the trigger may not be properly positioned to comfortably manipulate the trigger mechanism. One solution to such a drawback is proposed in U.S. Pat. No. 5,596,977 issued to Scott. The Scott patent teaches a bow string release device in which an adjustment mechanism is provided to alter the length between the wrist strap base and the release mechanism. Specifically, Scott teaches an inner shaft that slides inside an axial bore of an outer shaft. The inner shaft is attached to a wrist strap and the outer shaft is attached to a release mechanism. The outer shaft is provided with a number of transverse radial holes spaced apart along its length and the inner shaft is provided with at least one transverse hole for radial alignment with one of the holes of the outer shaft. The inner shaft is secured within the outer shaft by a bolt that extends radially through the aligned holes of the inner and outer shafts. The position of the inner shaft relative to the outer shaft, and hence the overall distance of the release mechanism from the wrist strap, can be altered by sliding the inner shaft within the outer shaft until the inner shaft hole is radially aligned with a different hole of the outer shaft.

A drawback to the adjustment mechanism of the Scott patent is found in the functional range permitted by the device. Specifically, the adjustment lengths of the Scott patent is confined to the spacing of the apertures along the outer shaft of the device. The device will only properly fit an archer's hand if the archer's hand size correlates to one of the spaced apart radial holes. Another drawback to the Scott patent is that the pin or bolt used to secure the inner and outer shafts together is a separate element that must be manipulated. As a separate element, the piece may be lost or dropped, rendering the release mechanism virtually unusable. Furthermore, as described above, the environments in which a bow string release device are typically may further frustrate use of a pin/adjustment hole configuration of the Scott patents, rendering the adjustment mechanism difficult to manipulate. For example, a gloved archer may have difficulty manipulating the small pin of the Scott patent, or debris may clog the axial holes used to lock the adjustment mechanism. Furthermore, proper axial alignment of the outer and inner shafts to permit a bolt to be inserted therein may be difficult to achieve, especially in a harsh environment or low light conditions.

SUMMARY OF THE INVENTION

The subject invention provides a bow string release mechanism having over and under bow string retaining jaws and an axial adjustment mechanism for altering the distance between the jaws and a wrist strap. The release mechanism generally comprises a release mechanism, a wrist strap, and a rotatable shaft assembly joining the release mechanism and the wrist strap, wherein the axial distance between release mechanism and the wrist strap can be adjusted by axial rotation of the shaft assembly. The release mechanism comprises a trigger mechanism, a body in which the trigger mechanism is mounted and actuated and a sear head attached to the body and actuable by the trigger mechanism. The sear head has a first fixed over and under sear element and a second pivotally attached over and under sear element, movable relative to the first fixed sear element, into and out of engagement therewith upon actuation of the trigger mechanism. The rotatable shaft assembly comprises a threaded bore at one end of a shaft to engage an externally threaded adjusting rod attached to the wrist strap. The shaft is attached at its other end, via a ball and socket coupling, to the release mechanism. The ball and socket coupling permits the release mechanism to freely pivot about the end of the shaft assembly. The threaded bore of the shaft permits the distance between the release mechanism and the strap to be rotatingly adjusted to accommodate various hand sizes.

The bow string release of the present invention is also provided with a side mounted trigger. A side mounted trigger is desirable because it permits the hand to be oriented in a natural, palm down position. This position generally reduces strain on the hand, especially as the hand is held ready to actuate a trigger for long periods of time, such as during hunting. In addition, this position permits natural flexing of the hand to actuate the trigger.

By using an axially threaded rod to secure the adjustment device of the present invention, rather than the radial mechanism of the prior art, the invention is less susceptible to the elements in which the it is operated. In addition, the threaded shaft permits much more precise axial adjustments than the mechanisms of the prior art. Thus, the drawbacks of the radial adjusting mechanism of the prior art are overcome. Furthermore, by utilizing an over and under sear head configuration with only a single moving jaw, the durability of an axially aligned bow string release is enhanced while the expense of manufacture is decreased.

BRIEF DESCRIPTION OF THE DRAWINGS

FIG. 4 is an elevation view of the bow string release of FIG. 1.

FIG. 5 is a partial, cut-away side view of the axial adjustment mechanism of the bow string release of FIG. 1.

DETAILED DESCRIPTION OF THE PREFERRED EMBODIMENTS

Figure 1:
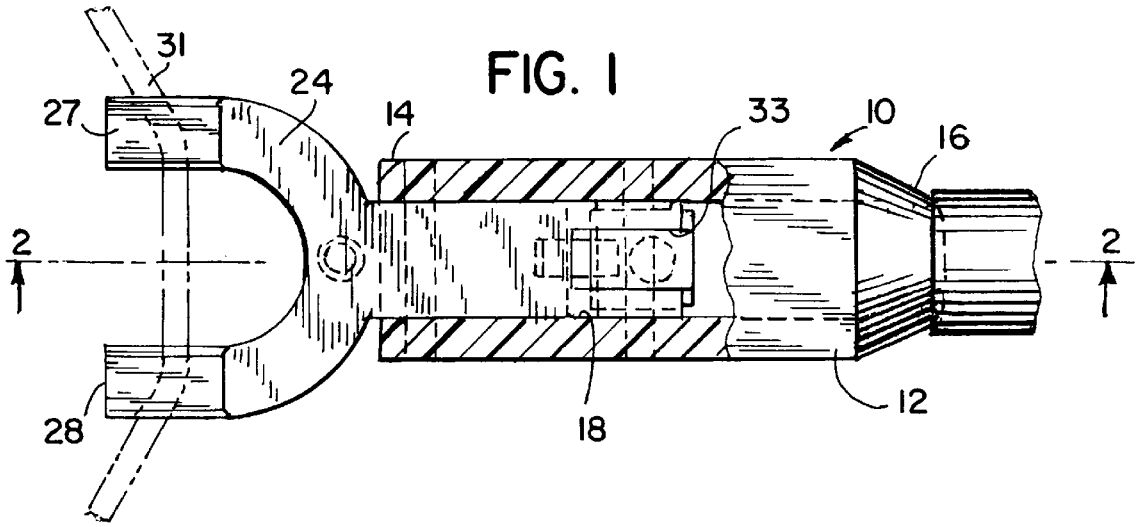
FIG. 1 is partial, cut-away side view of the bow string release of the present invention illustrating over and under jaws of the release.

A bow string release of the present invention is shown in FIGS. 1 and 4 and generally designated as 10. Bow string release 10 is comprised of a base 12 having a first end 14 and a second end 16. Base 12 defines an axial slot 18 extending from first end 14. A concave socket recess 20 (see FIG. 2) is provided at second end 16 with an aperture 22 permitting access to concave recess 20 as will be explained herein. A pair of opposing, over and under jaws 24, 26 are mounted in slot 18 and extend from first end 14. Jaw 24 is fixed to base 12, while jaw 26 is pivotally mounted to base 12. Each over and under jaw 24, 26 includes an upper engagement portion 27*a*, 27*b*, respectively, and a lower engagement portion 28*a*, 28*b*, respectively, spaced apart from their corresponding upper engagement portion 27*a*, 27*b*, sufficiently to allow an arrow nock (not shown) to be inserted therebetween. (See FIG. 4). Upper engagement portions 27*a*, 27*b* each define a bow string receiving notch 30, 32 for receipt of a bow string 31 (shown in relief). Likewise, lower engagement portions 28*a*, 28*b* each define a similar bow string receiving notch 30, 32. In the preferred embodiment, the portions of each bow string receiving notch 30, 32 farthest from the centerline of base 12 are rounded to prevent damage to bow string 31 during engagement by release 10.

Figure 2:
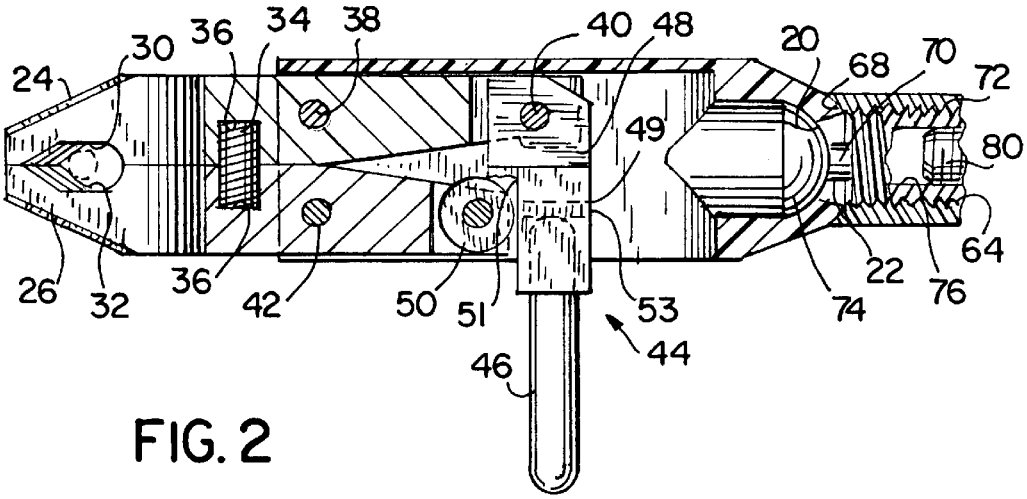
FIG. 2 is a cut-away top view of the bow string release of FIG. 1, illustrating the fixed over and under jaw and the pivotable over and under jaw oriented in a closed position.
Figure 3:
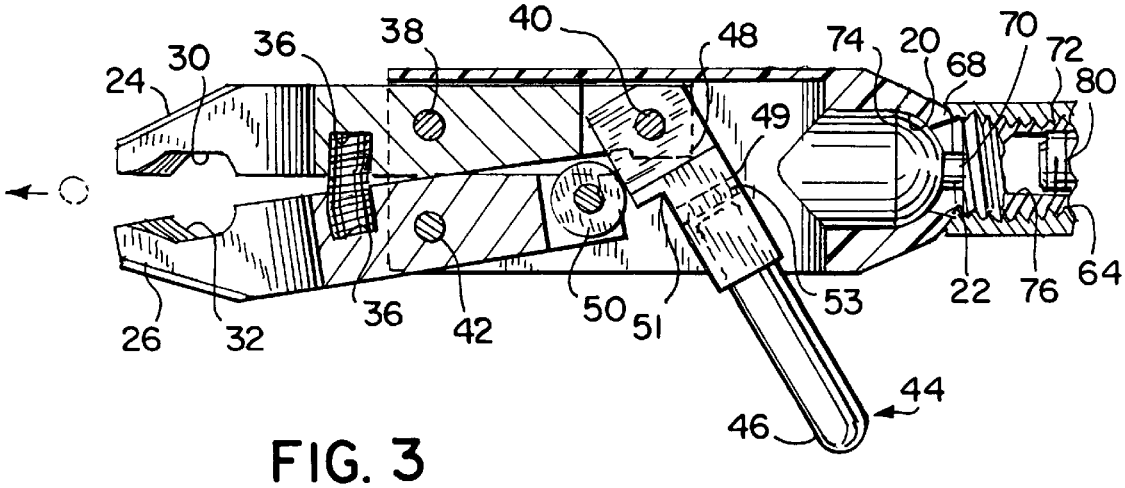
FIG. 3 is a cut-away top view of the bow string release of FIG. 1, illustrating the fixed over and under jaw and the pivotable over and under jaw oriented in an open position.

FIGS. 2 and 3 illustrate the fixed and pivotal nature of jaws 24, 26, respectively. Jaw 24 is fixed to base 12 by way of drive pins 38, 40. Jaw 26 is pivotally mounted to base 12 utilizing pin 42, such that jaw 26 pivots about pin 42. In the closed position, illustrated in FIG. 2, the opposing upper engagement portions 27*a*, 27*b* and the opposing lower engagement portions 28*a*, 28*b* of jaws 24 and 26 engage one another to retain bow string 31 in corresponding notches 30, 32, respectively.

In the open position illustrated in FIG. 3, spring 34 rides in opposing recesses 36 of jaws 24 and 26 and urges pivotal jaw 26 away from fixed jaw 24. A trigger mechanism 44 is shown pivotally attached to base 12 utilizing pin 40. As best seen in FIG. 1, the pinned end of fixed jaw 24 defines a slot 33 through which pin 40 extends when pin 40 is fixes jaw 24 in place. In this embodiment, fixed jaw 24 is longer than pivotal jaw 26, such that slot 33 is positioned past the end of pivotal jaw 26, enhancing the operation of trigger mechanism 44. The portion of pin 40 exposed in slot 33 is utilized as a rotational attachment point for trigger mechanism 44. As such, trigger mechanism 44 can turn within slot 33. Specifically, trigger mechanism 44 is provided with a trigger 46 and a cam element 48 and is oriented to extend horizontally from slot 33 when release 10 is attached to a vertical bow string. In other words, trigger 46 extends from the side of body 12 rather than from the top or bottom of body 12. Cam element 48 is rotatably mounted on fixed pin 40 to rotate in slot 33 of fixed jaw 24. Cam element 48 is also disposed to bear against roller 50, which is rotatingly mounted on pivotable jaw 26. Since jaw 26 is shorter than jaw 24, roller 50 is set in from the slotted end of jaw 24 where cam element 48 is attached. This spacial positioning permits roller 50 to more easily roll over the surface of cam element 48. In FIG. 2, trigger mechanism 44 is shown in a first position in which cam element 48 secures pivotable jaw 26 in the closed position. In the closed position, roller 50 seats in a notch 51 on the cam surface of cam element 48, preventing jaw 26 from pivoting under the pressure of spring 36. In FIG. 3, bow string release 10 is shown in the open position. As cam element 48 is pivoted about pin 40, roller 50 unseats from notch 51 and travels along the surface of cam element 48, permitting notched ends of bow string engagement portions 27*b*, 28*b* of jaw 26 to be urged away from bow string engagement portions 27*a*, 28*a* of fixed jaw 24 under force from spring 34.

Cam element 48 is also provided with a threaded bore hole 49 adjacent roller 50. Bore hole 49 is disposed for receipt of an adjustment screw 53. Adjustment screw 53 extends from bore hole 49 to rest against roller 50. The position of trigger 46 relative to roller 50, and hence the degree of trigger travel necessary to actuate release 10, can be adjusted utilizing screw 53.

The side extending trigger 46 permits trigger mechanism 44 to be actuated while maintaining one's hand in the palm down position. This hand orientation results in less fatigue on the hand and wrist during use of the bow string release. The hand may be maintained in a ready position for longer periods of time than the more common pistol grip position, in which the hand is held such that the palm is facing sideways.

In one embodiment, jaw 24 and jaw 26 are of the same shape, such that they are interchangeable for assembly purposes. Specifically, each jaw can have a notch 33. If the jaw is used as fixed jaw 24, the jaw may be pinned at two points and the trigger mechanism can be attached to rotate on the pin 40 within notch 33. If the jaw is used as pivoting jaw 26, roller 50 can be attached to rotate within notch 33. By utilizing interchangeable jaws such as this, manufacturing expense is reduced.

Those skilled in the art will understand that fixed jaw 24 could be integrally formed with body 12 without departing from the invention. In the most preferred embodiments, however, jaw 24 is a separate part attached to body 12 as described above.

Figure 6:
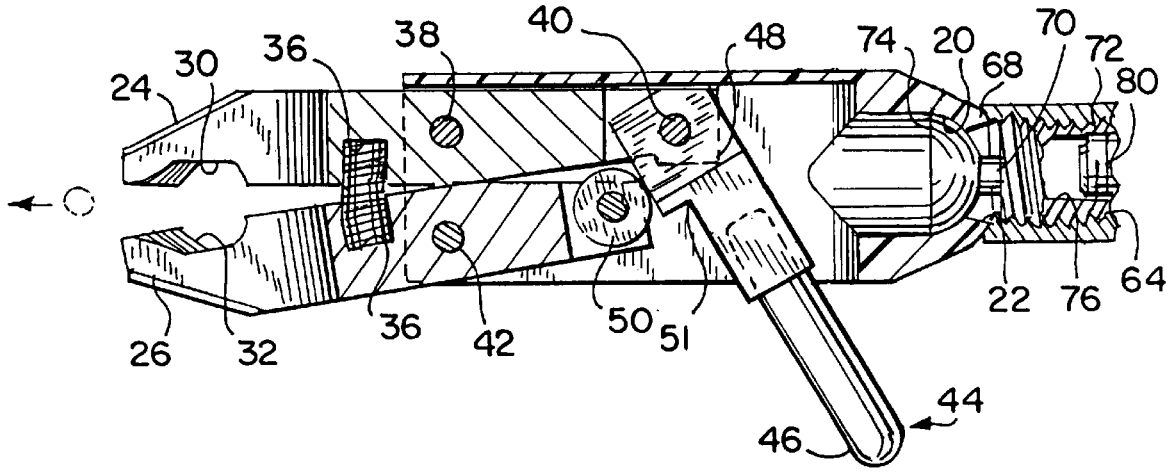
FIG. 6 is a cut-away top view of the bow string release of FIG. 1, illustrating over and under jaws on which only one jaw is notched.

In another embodiment, shown in FIG. 6, only one jaw is provided with bow string receiving notches. Specifically, fixed jaw 24 is provided with a substantially smooth surface at its upper and lower engagement portions 27*a*, 28*a*, while the upper and lower engagement portions 27*b*, 28*b* of pivotal jaw 26 are each provided with bow string receiving notch 32.

Turning to FIG. 5, an axial adjustment mechanism 60 is shown as part of bow string release 10 having a wrist strap 61. Adjustment mechanism 60 is attached to the bow string release 12 via a ball and socket joint as described herein. Adjustment mechanism 60 includes an adjusting sleeve 62. Adjusting sleeve 62 has a large threaded central bore 64 at one end and a small threaded bore 66 at the opposite end. The outer end 68 of adjusting sleeve 62, adjacent large threaded bore 64, is chamfered or concave for receiving the convex second end 16 of the body 12 of the release. The adjusting sleeve 62 is secured to body 12 via a screw or pin member 70 which, in the preferred embodiment, is a swivel screw having an externally threaded shaft 72 and a convex head 74. As mentioned above, convex head 72 is adapted to be received in concave socket 20 of body 12 and extend through aperture 22 for engagement with adjusting sleeve 62.

The arcs defining the convex head 74, the concave socket 20, the convex end 16, and the concave end 68 of adjusting sleeve 62 are in concentric and axial alignment with one another, respectively, such that the release body 10 can tilt relative to the axis of the adjusting sleeve 41, permitting further fine adjustment of the position of bow string release 10 relative to adjustment mechanism 60 and wrist strap 61. Thus, the ball and socket joint assembly permits both rotational and tilting adjustment of release 10 relative to adjustment mechanism 60 and wrist strap 61.

The small threaded bore 66 of adjusting sleeve 62 is disposed for receipt of a first threaded end 78 of adjusting rod 80 that is pivotally attached at its second end 82 to a wrist strap 61. It will be noted that swivel screw 70 includes a hollow, central bore 76 (FIGS. 2 and 3) adapted to permit end 78 of adjusting rod 80 to extend therein. End 82 of adjusting rod 80 is secured in a swing adaptor 63 attached to wrist strap 61.

Swing adaptor 63 includes a lower end comprising a cylindrical shaft 84 and an enlarged circular flat base 86. Shaft 84 is adapted to pass through a clearance hole 88 provided in wrist strap 61. A headed screw 90 is then threadably received in a threaded enlarged central bore 92 of adaptor 63 to secure adaptor 63 to strap 61.

The upper end of swing adaptor 63 includes an enlarged cylindrical shaft 92 with a protruding, tapered lip or barb 94 on its outer perimeter. End 82 of adjusting rod 80 is threadably received in bore 92 of swing adaptor 63 and is tightened therein for securely holding the adjusting rod relative to the wrist strap.

In order to alter the distance between release 10 and strap 61, the adjusting mechanism 60 is rotated to axially advance or retract release 10 along adjusting rod 80. Release 10 moves in unison with adjusting sleeve 62 since it is secured thereto via the ball and socket joint. Those skilled in the art will understand that due to the axially engaged threads and the universal ball and socket joint, distance adjustments can be very precise along the length of adjusting rod 10, permitting adjustment to correctly and comfortably fit virtually any size hand.

In order to assure against incidental rotation of the adjusting sleeve 62 relative to adjusting rod 80, a resilient, tight fitting outer sleeve 96 is secured to the adjusting sleeve as shown in FIG. 5. Sleeve 96 extends downwardly over shaft portion 92 of swing adaptor 63, securely engaging tapered lip 94 and at least partially encasing adjusting rod 80. The open end of sleeve 96 likewise frictionally engages adjusting sleeve 62, assuring against incidental rotation of the adjusting sleeve relative to the adjusting rod and the wrist strap.

By utilizing axial adjustment assembly 60 for securing body 12 to strap 61, the entire release 10 and adjustment assembly 60 can be pivoted downwardly or upwardly out of firing position, moving the release to a position along side the wrist and hand on either side and releasing the hand for other functions without removing the wrist strap from the wrist.

The above described bow string release provides a number of advantages over the prior art. The release is axially adjustable and securable due to the axial adjustment mechanism. As such, the device does not require alignment of certain holes or manipulation of locking pins or screws. Furthermore, a sleeve disposed over the adjustment mechanism prevents incidental rotation and serves as a barrier to protect the threads of an adjusting rod. Having over and under jaws, the release permits axial alignment of an arrow and the release, while at the same time properly aligning the bow string with an arrow nock, thus maximizing the force applied by the bow to an arrow upon release. In addition, the release as described is much less complex than other releases in the prior art. For example, the axial adjustment mechanism generally comprises an axially threaded shaft and a threaded rod, while the release mechanism includes only a minimum number of moving parts, namely a jaw, a roller, and a trigger. This simplicity of design minimizes maintenance, expense and susceptibility to damage, and enhances assembly and operation. The simplicity of design also results in an additional benefit, namely, less hand fatigue due to the side mounted trigger mechanism.

While the preferred embodiment of the subject invention includes a plurality of unique features, it will be readily understood that the various features in combination greatly enhance the function, operation, durability and manufacturability of the bow string release mechanism. Thus, while specific features and embodiments of the invention have been described in detail herein, it will be readily understood that the invention encompasses all modifications and enhancements within the scope and spirit of the following claims.

What is claimed is:

1. A bow string release for engaging and releasing a bow string by actuation of a trigger, said release comprising:

A. a body having an axial slot open to a first end of the body;

B. a first sear element extending from said slot and fixedly attached therein;

C. a second sear element extending from said slot and pivotally attached therein;

D. wherein each sear element comprises a first end and a second end, the first end having a U-shaped portion defining an upper and lower arm, each of said upper and lower arms having a notch defined therein for receipt of a bow string, and the second end defining a slot therein;

E. a trigger mechanism pivotally mounted in the slot of the first sear element, the trigger mechanism defining a first cam surface thereon;

F. a second cam surface adjacent the slot of the second sear element, the second cam surface disposed to bear against the first cam surface of the trigger mechanism and travel along the first cam surface as the trigger mechanism is pivoted; and G. a spring disposed between the first fixed sear element and the second pivotable sear element to urge the second sear element away from the first sear element.

2. The bow string release of claim 1 further including a set screw extending from the cam surface of the trigger mechanism.

3. The bow string release of claim 1 wherein a socket with an aperture therein is defined at a second end of the body, and the release further includes A. an adjusting sleeve having a ball mounted on one end and an axially threaded bore disposed in the other end, wherein the ball pivotally seats within the socket of the release body and the adjusting sleeve extends through the open aperture;

B. an externally threaded adjusting rod for engaged with the threads of the adjusting sleeve bore; and C. a wrist strap attached to the adjusting rod.

4. A bow string release for engaging and releasing a bow string, said release comprising:

A. a body;

B. a sear head attached to the body, the sear head having a first over and under sear element, and a second over and under sear element, wherein each sear element includes a first end with an upper bow string engagement portion and a lower bow string engagement portion, spaced apart from the upper bow string engagement portion, and a second end, and wherein said sear elements are interchangeable with one another;

C. a trigger mechanism mounted on the second end of one of the sear elements; and D. a cam mechanism mounted on the second end of the other sear element, E. wherein the second end of each sear element defines a slot therein, said slot disposed for interchangeable receipt of said trigger mechanism or said cam mechanism.

5. The bow string release of claim 4, further comprising a spring for urging the second pivotal sear element away from the first fixed sear element.

6. The bow string release of claim 4, wherein the first sear element is fixed, and the upper and lower bowstring engagement portions thereof are each notched for receipt of a bow string.

7. The bow string release of claim 4, wherein the second sear element is pivotal, and the upper and lower bowstring engagement portions thereof are each notched for receipt of a bow string.

8. A bow string release for engaging and releasing a bow string, said release comprising:

A. a body;

B. a sear head attached to the body, the sear head having a first over and under sear element, and a second over and under sear element, wherein each sear element includes a first end with an upper bow string engagement portion and a lower bow string engagement portion, spaced apart from the upper bow string engagement portion, and a second end, and wherein said sear elements are interchangeable with one another;

C. a trigger mechanism mounted on the second end of one of the sear elements; and D. a cam mechanism mounted on the second end of the other sear element, E. wherein the sear element with the trigger mechanism is fixedly attached to the body and the sear element with the cam mechanism is pivotally attached to the body and movable, relative to the first fixed sear element, into and out of engagement therewith upon actuation of the trigger mechanism.

9. The bow string release of claim 8 further including

A. a wrist strap; and

B. an axial rotatable shaft assembly joining the release mechanism and the wrist strap, the shaft assembly comprising (1) a shaft having a first end and a second end with an axial, threaded bore disposed in the first end, the second end being attached to the release mechanism; and (2) an externally threaded adjusting rod for engagement with the threaded bore of the shaft, the adjusting rod being attached at one end to the strap.

10. The bow string release of claim 9, further comprising a ball and socket joint joining the shaft assembly and the release mechanism, wherein the second end of the shaft is provided with a ball for mating with a socket provided on the release mechanism.

11. The bow string release of claim 9, further comprising a resilient sleeve surrounding at least a portion of the adjusting rod.

* * * * *